US005437115A

United States Patent [19]

Freese et al.

[11] Patent Number: 5,437,115

[45] Date of Patent: Aug. 1, 1995

[54] SECURITY GATE APPARATUS

[75] Inventors: T. Brent Freese, Westminster; Robert M. Parker, Aurora, both of Colo.

[73] Assignee: Gerry Baby Products Company, Thornton, Colo.

[21] Appl. No.: 238,367

[22] Filed: May 5, 1994

[51] Int. Cl.[6] ..... E05C 21/02

[52] U.S. Cl. ..... 49/465; 49/55; 49/57; 49/449

[58] Field of Search ..... 49/465, 463, 55, 57, 49/449, 450, 394; 160/225, 224

[56] References Cited

U.S. PATENT DOCUMENTS

| | | | |
|---|---|---|---|
| 2,581,857 | 1/1952 | Harrison | 169/217 |
| 2,851,746 | 9/1958 | McPhaden | 49/55 X |
| 2,928,146 | 3/1960 | Kuniholm | 49/55 X |
| 3,680,260 | 8/1972 | Bauer | 49/465 |
| 4,607,455 | 8/1986 | Bluem et al. | 49/55 |
| 4,677,791 | 7/1987 | Larson et al. | 49/463 |
| 4,787,174 | 11/1988 | Brown | 49/55 |
| 4,944,117 | 7/1990 | Gebhard et al. | 49/55 |
| 5,052,461 | 10/1991 | Stern | 160/224 |
| 5,272,840 | 12/1993 | Knoedler et al. | 49/463 |

*Primary Examiner*—Philip C. Kannan

*Attorney, Agent, or Firm*—Biebel & French

[57] ABSTRACT

A security gate apparatus for attachment across an opening defined by first and second vertical surfaces, including a first gate panel and a second gate panel slidingly connected to the first gate panel so as to permit horizontal extension and retraction of the gate apparatus to a desired horizontal dimension. A first vertical leg is pivotably attached to an outer vertical member of the first gate panel by a first link means and a second vertical leg is pivotably connected to an outer vertical member of the second gate panel by a second link means. The security gate apparatus also includes means for locking the first and second gate panels in the desired horizontal dimension and at least one contact pad on a surface of the first and second vertical legs opposite the outer vertical members of the first and second gate panels, respectively. The security gate apparatus is then installed between the first and second vertical surfaces by pivoting the first and second link means to provide a vertical movement between the first and second gate panels and the first and second vertical legs, as well as a corresponding horizontal movement therebetween, whereby the contact pads frictionally engage the first and second vertical surfaces.

17 Claims, 6 Drawing Sheets

SECURITY GATE APPARATUS

BACKGROUND OF THE INVENTION

1. Field of the Invention

This invention relates generally to a security gate apparatus for attachment across an opening defined by a pair of vertical surfaces and, more particularly, to a security gate apparatus having a pair of horizontally adjustable gate panels which frictionally engage the pair of vertical surfaces by means of a pivoting motion between the gate panels and a pair of outer vertical legs.

2. Description of Related Art

In environments where small children, infants or pets are present, it is generally desirable to have a security gate or closure device which may be removably placed within a doorway to prevent passage therethrough. For example, it may be desirable to restrict small children to a particular room without shutting the door to the room such that one can look into the room or the children can see an adult nearby.

Various prior art gate devices have been proposed wherein the gate may be removably mounted within a doorway and which typically include means for adjusting. the width of the gate to accommodate different doorway widths. For example, U.S. Pat. No. 4,492,263 to Gebhard discloses an infant security door gate assembly which includes upper and lower support bars incorporating coil springs positioned within telescoping tubes to form a compression friction fit within the doorway. In addition, the gate is formed of a pair of complementary panels which follow the telescoping expansion and contraction of the support bars.

U.S. Pat. No. 4,944,117 to Gebhard et al. discloses another construction for a security gate including a pair of overlapping panels which may be adjusted relative to each other to provide a general width adjustment for the gate to be positioned in close proximity to the sides of the doorway. A mechanism is provided along the edge of one of the panels including a foot operated actuator for moving a pair of edgeblocks outwardly from the edge of the panel to frictionally engage the side of the doorway.

While the above-described gates are satisfactory for preventing passage of a small child, infant or pet through the doorway, a gate providing maximum convenience is desired when the doorway must be temporarily opened to allow passage therethrough, such as when an adult desires to pass into or out of a room for which the gate is acting as a closure device. In a further prior art gate which attempts to address this desire, a mounting frame is provided for the gate including two vertically extending sections for engaging opposing sides of the doorway. A pair of panels is provided between the frame sections wherein one panel is rigidly attached to the frame and a second panel is pivotally connected to the first panel and includes a release latch for engaging one of the vertical sections to maintain the gate in a closed position. Thus, the frame portion may be positioned in frictional contact with the sides of a doorway and the pivoted section may be opened and closed as needed to allow passage through the doorway. One problem with the latter described security gate, however, is that a toddler may easily learn how to manipulate the safety release latch to open the gate such that the gate is limited in its application to use with infants and pets.

Accordingly, there is a need for a security gate for use as a closure within a, doorway which is easily adjustable to the doorway and which permits easy passage for an adult through the doorway. One such attempt is disclosed in U.S. Pat. No. 5,052,461 to Stern, where a security gate is disclosed which is able to be installed and released by one hand. In particular, this gate includes two panels which are extendable with respect to each other and may be locked in an extended position. A handle is located centrally on the top of the gate and is connected by a pair of cranks and a pull rod to a pair of plungers which contact one side of the doorframe. A spring bias on the plungers normally force the plungers into contact with the doorframe, but the handle may be employed to withdraw the plungers from contact with the doorframes. While this design has proven to be effective for its intended purpose, it has been found that a simpler design with fewer moving parts would be desirable, especially since such a design would be more economical.

SUMMARY OF THE INVENTION

A security gate apparatus for attachment across an opening defined by first and second vertical surfaces, including a first gate panel and a second gate panel slidingly connected to the first gate panel so as to permit horizontal extension and retraction of the gate apparatus to a desired horizontal dimension. A first vertical leg is pivotably attached to an outer vertical member of the first gate panel by a first link means and a second vertical leg is pivotably connected to an outer vertical member of the second gate panel by a second link means. The security gate apparatus also includes means for locking the first and second gate panels in the desired horizontal dimension and at least one contact pad on a surface of the first and second vertical legs opposite the outer vertical members of the first and second gate panels, respectively. The security gate apparatus is then installed between the first and second vertical surfaces by pivoting the first and second link means to provide a vertical movement between the first and second gate panels and the first and second vertical legs, as well as a corresponding horizontal movement therebetween, whereby the contact pads frictionally engage the first and second vertical surfaces.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
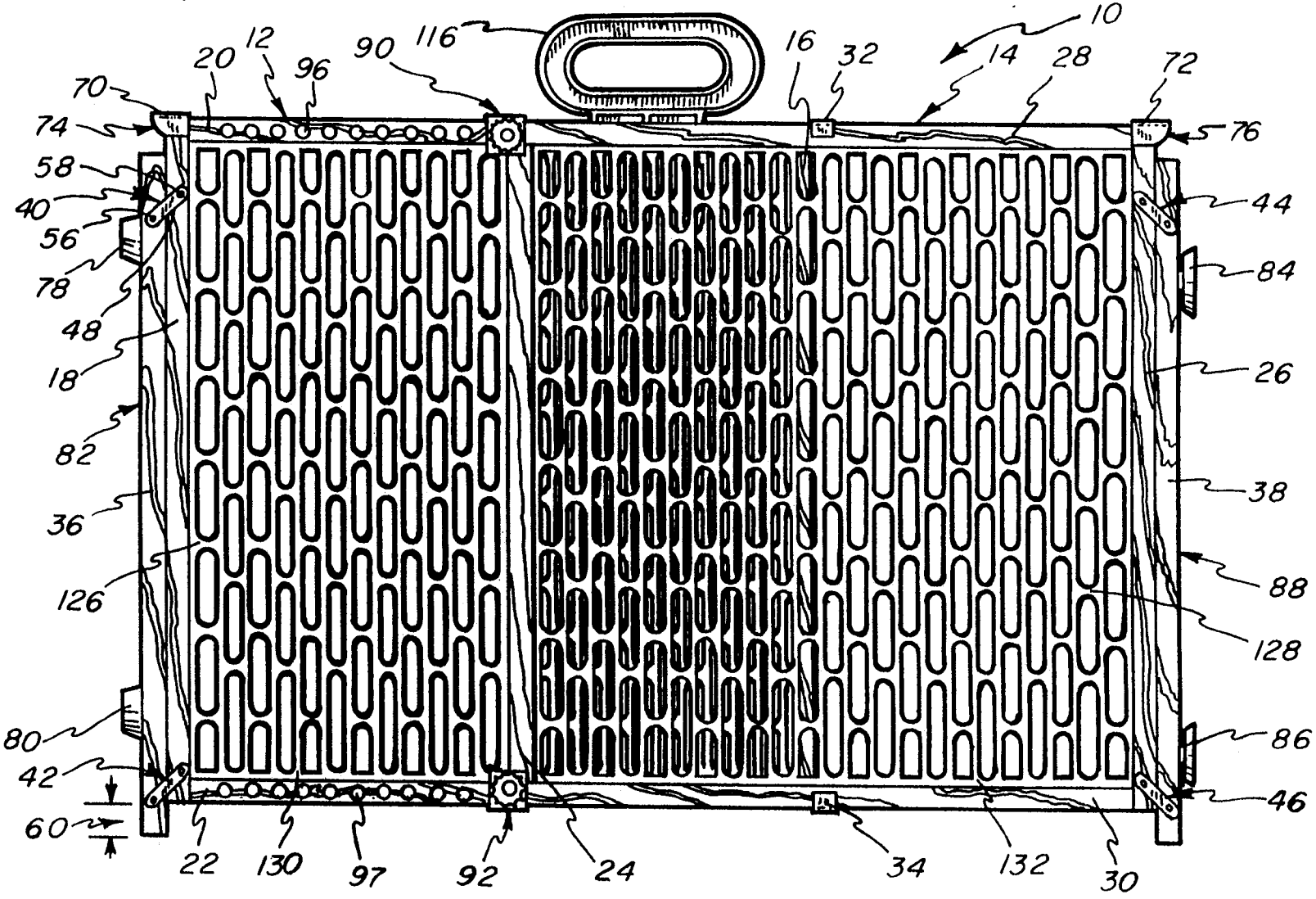
FIG. 1 is a front elevational view of the security gate apparatus of the present invention in the release or disengaged position.

Referring now to the drawings in detail, wherein identical numerals indicate the same elements throughout the Figures, FIG. 1 depicts a security gate apparatus 10 having a first gate panel 12 and a second gate panel 14 slidingly connected to first gate panel 12. It can be seen that first gate panel 12 includes an inner vertical member 16 and an outer vertical member 18, as well as a top horizontal member 20 and a bottom horizontal member 22. Likewise, second gate panel 14 includes an inner vertical member 24 and an outer vertical member 26, as well as a top horizontal member 28 and a bottom horizontal member 30. First gate panel 12 and second gate panel 14 are connected by means of a pair of brackets 32 and 34 along top horizontal members 20 and 28 and bottom horizontal members 22 and 30, respectively. In order to allow horizontal extension and retraction of security gate apparatus 10 to a desired horizontal dimension, brackets 32 and 34 are fixedly connected to the top and bottom horizontal members of only one of the panels. As shown in FIG. 1, brackets 32 and 34 are fixedly connected (e.g., by a screw or other means) to top horizontal member 20 and bottom horizontal member 22 of first gate panel 12. Since brackets 32 and 34 are U-shaped in design, a depending leg of brackets 32 and 34 (not shown) is adjacent the vertical surfaces of top horizontal member 28 and bottom horizontal member 30 of second gate panel 14 to retain second gate panel 14 in position and allows horizontal sliding with respect to first gate panel 12.

Figure 5:
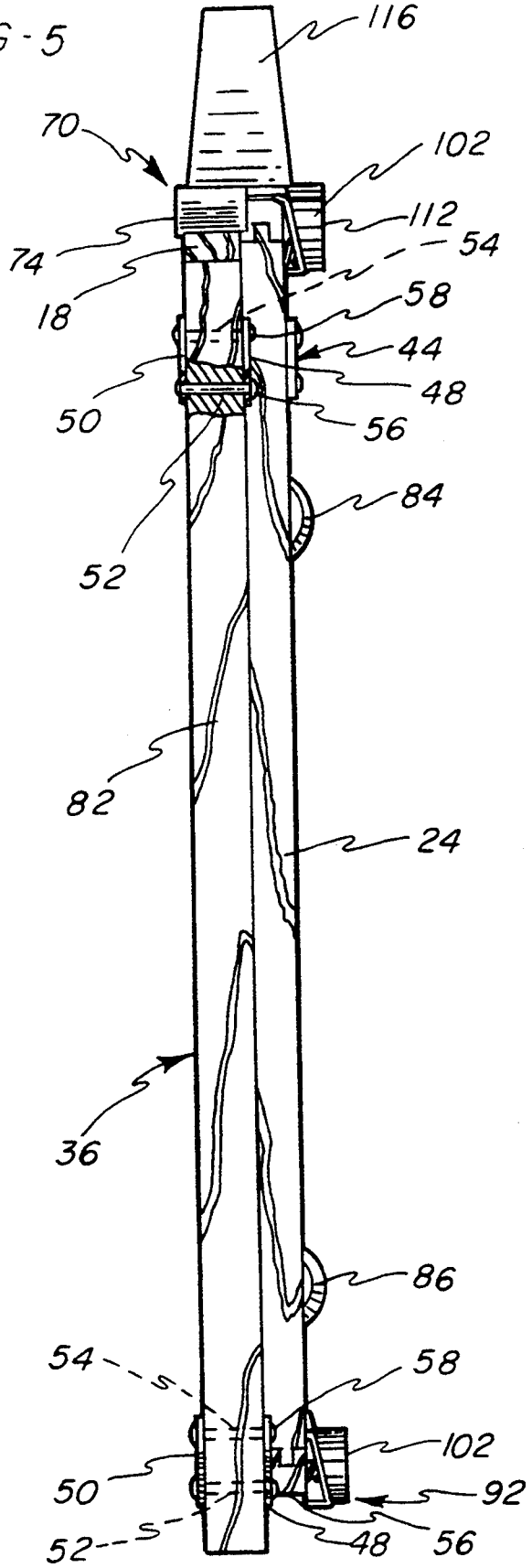
FIG. 5 is a side view of the security gate apparatus of FIG. 1, where the contact pads have been removed for clarity.

It will further be seen that a pair of vertical legs 36 and 38 are adjacent to outer vertical members 18 and 26, respectively. A pair of linking means 40 and 42 pivotably connect vertical leg 36 to vertical member 18 adjacent the top and bottom portion thereof. Likewise, a pair of top and bottom linking means 44 and 46 pivotably connect vertical leg 38 and outer vertical member 26. Upon inspection of FIGS. 1 and 5, it is seen that each linking means 40, 42, 44, and 46 includes a pair of links 48 and 50 aligned along vertical leg 36 and outer vertical member 18 (as well as vertical leg 38 and outer vertical member 26) with a first pin 52 connecting links 48 and 50 to vertical leg 36 and a second pin 54 connecting links 48 and 50 to outer vertical member 18. Pins 52 and 54 are constructed with heads 56 and 58 on one end and are turned on the other end so that links 48 and 50 are retained but are allowed to rotate or pivot in a plane parallel to first and second gate panels 12 and 14.

Figure 3:
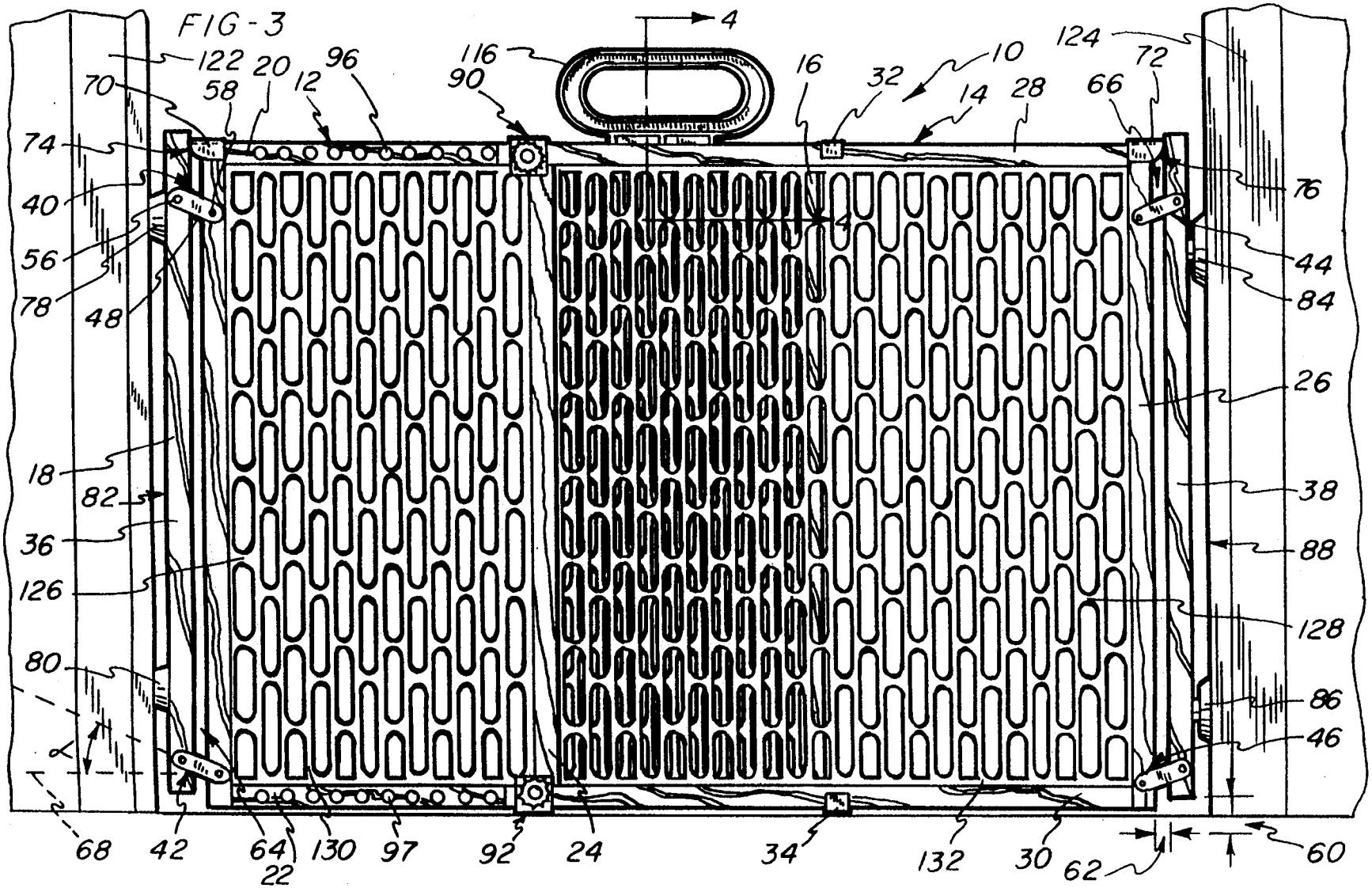
FIG. 3 is a front elevational view of the security gate apparatus of FIG. 1 in the installed position between a pair of vertical surfaces.

It will be understood from FIG. 3 that the pivoting of vertical legs 36 and 38 with respect to outer vertical members 18 and 26, respectively, involves both a vertical component 60 and a horizontal component 62. As seen in FIG. 1, vertical members 36 and 38 lie adjacent to and somewhat below outer vertical members 18 and 26 when security gate apparatus 10 is not in use or disengaged from a pair of vertical surfaces such as a doorway. When in the installed position (see FIG. 3), vertical legs 36 and 38 are substantially aligned with outer vertical members 18 and 26, a pair of horizontal spaces 64 and 66 is provided between vertical leg 36 and outer vertical member 18 and outer vertical leg 38 and outer vertical member 26, and links 48 and 50 of linking means 40, 42, 44, and 46 are at an angle $\alpha$ to a horizontal plane 68 which is perpendicular to outer vertical members 18 and 26. Further detail regarding the installation and disengagement of security gate apparatus 10 between a pair of vertical surfaces will be discussed in more detail below.

It will be seen that a pair of stops 70 and 72 are provided at the top portion of outer vertical members 18 and 26. Stops 70 and 72 are each provided with a cammed surface 74 and 76, respectively, which vertical legs 36 and 38 engage and follow during rotation. Because the horizontal component 62 of the pivoting motion between vertical legs 36 and 38 and outer vertical members 18 and 26 must be maintained at installation, stops 70 and 72 prevent over-rotation thereof which would eliminate the desired horizontal spaces 64 and 66. It should be noted that the cammed surfaces 74, 76 also ensure that the outer vertical members 36 and 38 are biased outwardly as they move into a positive stop position against the stops 70 and 72. Additionally, a pair of contact pads 76 and 78 are preferably provided on an outer surface 82 of vertical leg 36. Likewise, a pair of contact pads 84 and 86 are preferably provided along an outer surface 88 of vertical leg 38. It is preferred that at least one pair of contact pads, such as shown by contact pads 84 and 86, be adjustable (e.g., by means of screws or the like) so as to provide fine adjustment for security gate apparatus 10 between a pair of vertical surfaces 122 and 124 due to surface irregularities and the like (see FIG. 3).

Figure 2:
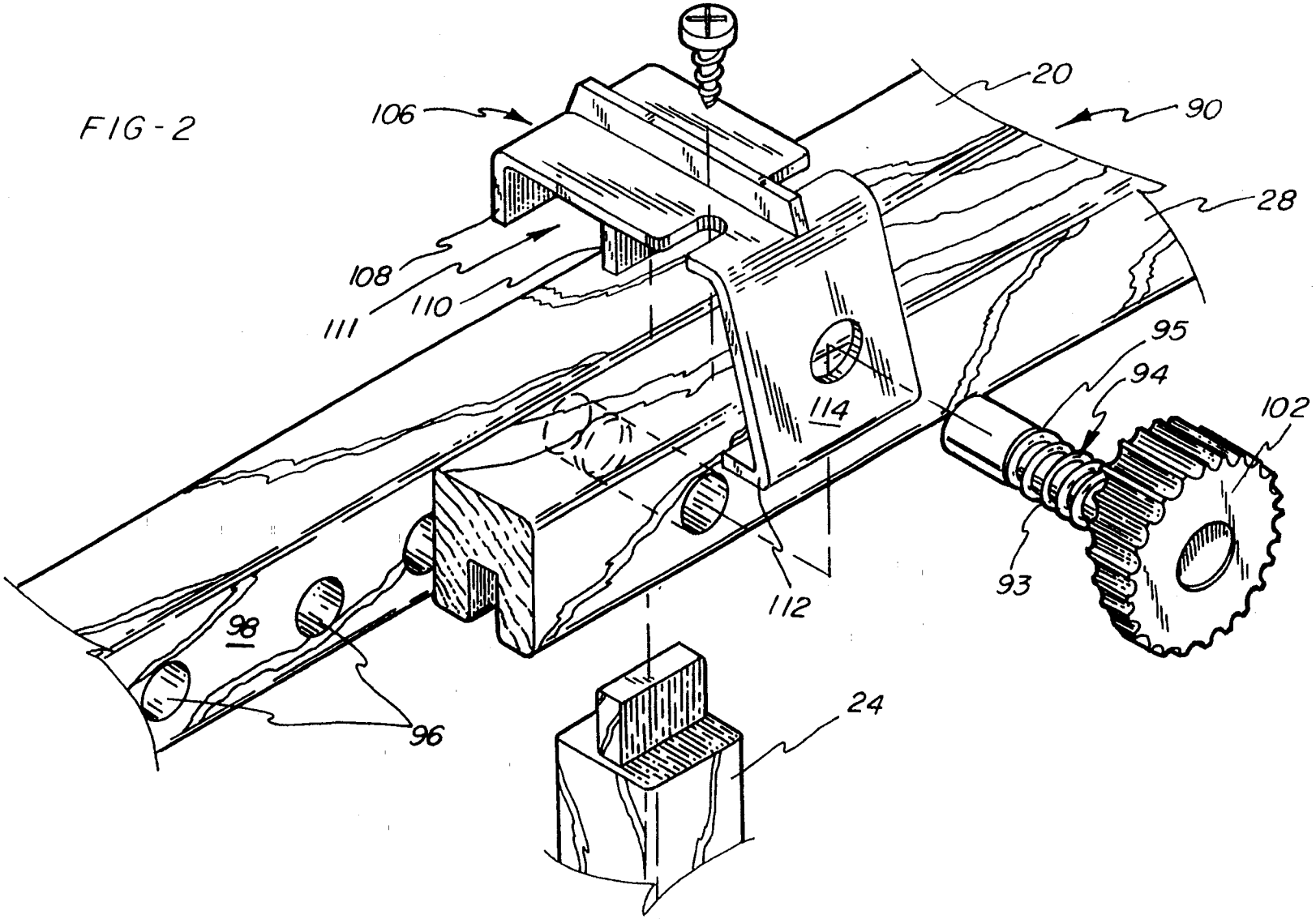
FIG. 2 is an exploded perspective view of one of the locking means in the security gate apparatus of FIG. 1.
Figure 6:
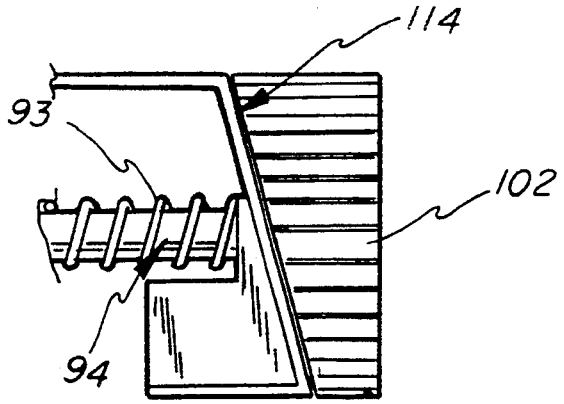
FIG. 6 is a partial side view of a locking mechanism in the present invention, where it is in the locked position.
Figure 7:
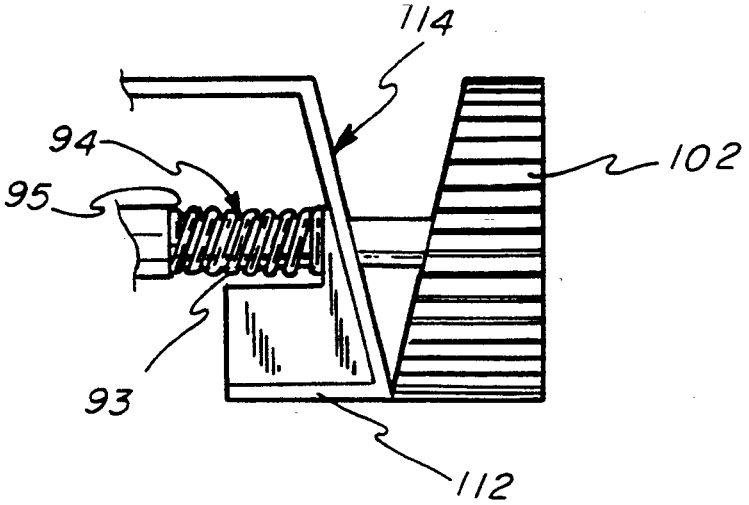
FIG. 7 is a partial side view of the locking mechanism of FIG. 6 in the unlocked position.

As stated previously herein, first gate panel 12 and second gate panel 14 are slidably connected and may be adjusted to a desired horizontal dimension. In order to retain gate panels 12 and 14 in this position, pair of locking means 90 and 92 are provided along the top and bottom horizontal members thereof. As seen in greater detail in FIG. 2 with respect to locking means 90, each locking means includes a spring-loaded pin member 94 which engages one of a plurality of horizontally spaced sockets 96 and 97 formed on vertical surfaces 98 and 100, respectively, of top horizontal member 20 and bottom horizontal member 22 of first gate panel 12. It will be seen that a spring 93 is retained on pin 94 at one end by a shoulder 95 and that the other end of the pin 94 has an enlarged head 102 attached thereto, wherein the enlarged head 102 includes an angled inner surface 104. A bracket 106 is utilized in conjunction with pin 94 for each locking means 90 and 92, Bracket 106 has a first leg 108 and a second leg 110 in order to form a channel 111 for top and bottom horizontal members 20 and 22 to slide within. A third leg 112 of bracket 106 extends below top horizontal member 28 and above bottom horizontal member 30 of second gate panel 14, with an outer surface 114 of third leg 112 in abutment with inner surface 104 of pin head 102. As best seen in FIG. 6, outer surface 114 is angled so that angled inner surface 104 of pin head 102 lies flat thereagainst when pin 94 is in engagement with a socket 96 or 97. To promote disengagement of pin 94 from a particular socket 96 or 97, pin head 102 should be rotated to cause a camming action to occur between inner surface 104 of pin head 102 and outer surface 114 of bracket 106 (see FIG. 7). In this manner, the desired horizontal dimension for security gate apparatus 10 is obtained for a particular doorway opening but may be adjusted likewise for a different doorway or opening.

Figure 4:
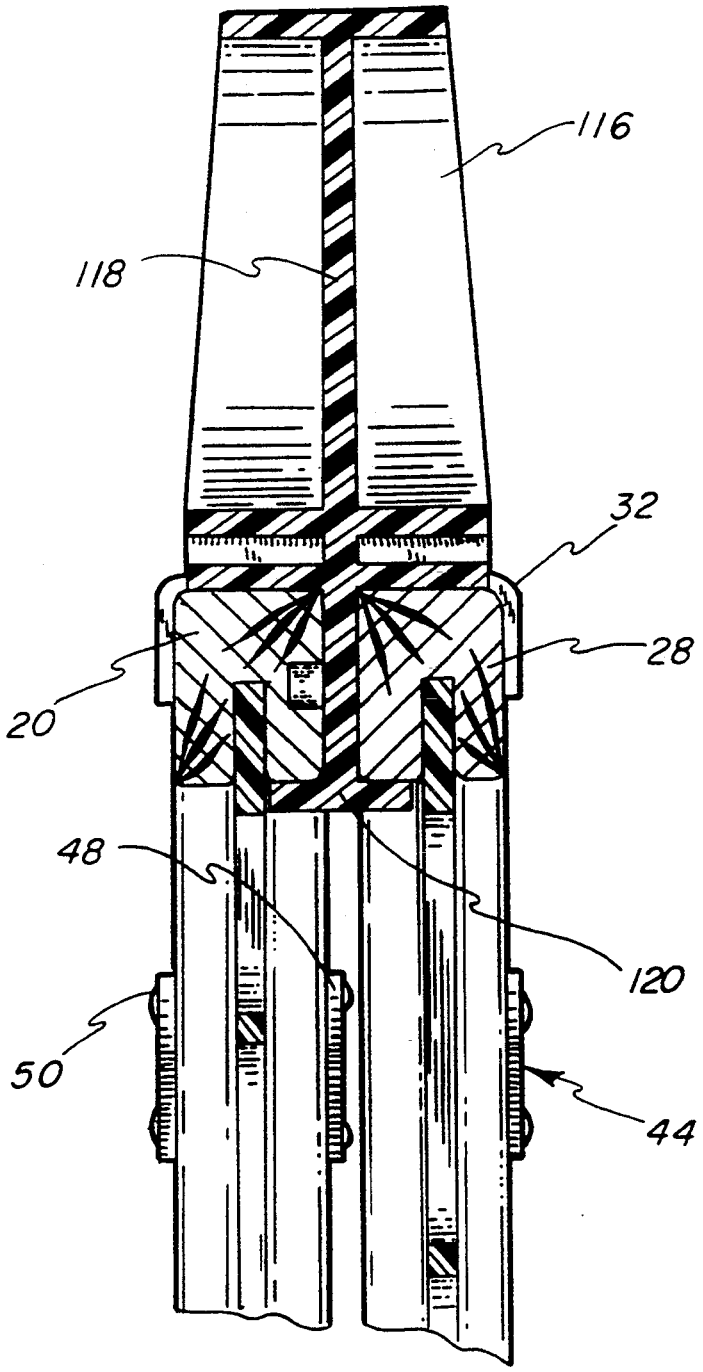
FIG. 4 is a partial sectional view of the security gate apparatus of FIG. 1, taken along line 4—4 of a FIG. 3.

Referring to FIG. 4, a handle 116 is provided adjacent top horizontal members 20 and 28 of first gate panel 12 and second gate panel 14, respectively. Handle 116 includes a T-shaped member 118 that it may be slid horizontally on top of horizontal members 20 and 28. A base portion 120 of handle 116 engages the bottom surfaces of top horizontal members 20 and 28, thus enabling the lifting of handle 116 to disengage security gate apparatus 10.

It will also be seen that first and second gate panels 12 and 14 are provided with grid areas 126 and 128, respectively. Grid areas 126 and 128 include edge portions 130 and 132 which define the peripheral edges of first and second gate panels 12 and 14. Grid areas 126 and 128 provide a lightweight closure structure while also permitting children and pets to be able to see through security gate apparatus 10.

In operation, security gate apparatus 10 is installed by first making a gross adjustment of the gate's horizontal dimension by positioning locking means 90 and 92 so that pins 94 engage the appropriate sockets 96 and 97. This is done by first rotating pin heads 102 approximately 90° so that pins 94 do not engage top and bottom sockets 96 and 97. Gate panels 12 and 14 are then adjusted so that the total horizontal length of security gate apparatus 10 is slightly greater than the width of a pair of vertical surfaces 122 and 124 with which it is to be utilized such as for a doorway or other opening. Pins 94 are then allowed to engage the nearest socket by again rotating pin heads 102 approximately 90°. It will be understood that pins 94 for each locking means 90 and 92 should be engaged with sockets 96 and 97 in top horizontal member 20 and bottom horizontal member 22 which are vertically aligned.

Next, handle 116 should be slid to the approximate center of security gate apparatus 10. Using handle 116, security gate apparatus 10 is lifted and positioned between vertical surfaces 122 and 124 for the desired opening or doorway. Then, security gate apparatus 10 is pushed downwardly into place, which causes pivoting between vertical legs 36 and 38 and outer vertical members 18 and 26, respectively, until vertical legs 36 and 38 engage the cammed surfaces 74 and 76 of stops 70 and 72. As stated hereinabove, this pivoting action causes a horizontal spacing 64 and 66 which allows security gate apparatus 10 to wedge tightly against the vertical surfaces 122 and 124 of the opening to cause a compression friction fit. In order to release security gate apparatus 10 after installation, one need only pull up on handle 116. Such action causes vertical legs 36 and 38 to draw downwardly and in toward outer vertical members 18 and 26, thus releasing the outward pressure of vertical lines 36 and 38 on vertical surfaces 122 and 124 of the opening.

Having shown and described the preferred embodiment of the present invention, further adaptations of the invention can be accomplished by appropriate modifications by one of ordinary skill in the art without departing from the scope of the invention.

What is claimed is:

1. A security gate apparatus for attachment across an opening defined by first and second vertical surfaces, said apparatus comprising:

(a) a first gate panel having top and bottom horizontal members and inner and outer vertical members;

(b) a second gate panel having top and bottom horizontal members and inner and outer vertical members, said second gate panel being slidingly connected to said first gate panel so as to permit horizontal extension and retraction of said gate apparatus to a desired horizontal dimension;

(c) a first vertical leg pivotably attached to said outer vertical member of said first gate panel by a first link means;

(d) a second vertical leg pivotably attached to said outer vertical member of said second gate panel by a second link means;.

(e) means for locking said first and second gate panels at said desired horizontal dimension; and (f) at least one contact pad on a surface of said first and second vertical legs opposite said outer vertical members of said first and second gate panels, respectively;

wherein said security gate apparatus is installed between said first and second vertical surfaces by pivoting said first and second link means to provide a vertical movement between said first and second gate panels and said first and second vertical legs and a corresponding horizontal spacing therebetween, whereby said contact pads frictionally engage said first and second vertical surfaces.

2. The security gate apparatus of claim 1, further including a cammed stop member positioned on each of said outer vertical members of said first and second gate panels, wherein said first and second vertical legs are prevented from over-rotating during installation of said security gate apparatus between said first and second vertical surfaces.

3. The security gate apparatus of claim 1, said locking means further comprising:

(a) a spring-loaded pin member having a head with an angled inner surface;

(b) a plurality of sockets contained in a horizontal member of said first gate panel; and (c) a bracket which engages an adjacent pair of horizontal members of said first gate panel and said second gate panel, said bracket including an angled outer surface;

wherein said angled inner surface of said pin head abuts said angled outer surface of said bracket, whereby said pin member is moved into and out of said sockets by rotation of said pin head.

4. The security gate apparatus of claim 3, wherein said locking means is provided at both said top and bottom horizontal members of said first and second gate panels.

5. The security gate apparatus of claim 1, wherein said contact pad of said first vertical leg is in a fixed position.

6. The security gate apparatus of claim 5, wherein said contact pad of said second vertical leg is horizontally adjustable.

7. The security gate apparatus of claim 1, wherein said first and second link means are at an angle to a horizontal plane perpendicular to said outer vertical members of said first and second gate panels upon installation of said security gate apparatus between said first and second vertical surfaces.

8. The security gate apparatus of claim 1, wherein said first and second link means include a pair of pivotable links attached adjacent upper and lower ends of said first and second vertical legs.

9. The security gate apparatus of claim 1, further including a grid between said horizontal and vertical members of said first and second gate panels.

10. The security gate apparatus of claim 1, further including a handle slidable along said top horizontal members of said first and second gate panels.

11. A security gate apparatus for attachment across an opening defined by first and second vertical surfaces, said apparatus comprising:

(a) a gate panel having top and bottom horizontal members and first and second vertical members;

(b) a first vertical leg pivotably attached to said first vertical member of said gate panel by a first link means;

(c) a second vertical leg pivotably attached to said second vertical member of said gate panel by a second link means;

(d) at least one contact pad on a surface of said first and second vertical legs opposite said first and second vertical members of said gate panel, wherein said security gate apparatus is installed between said first and second vertical surfaces by pivoting said first and second link means to provide a vertical movement between said gate panel and said first and second vertical legs and a corresponding horizontal spacing therebetween, whereby said contact pads frictionally engage said first and second vertical surfaces; and (e) a cammed stop member positioned on each of said first and second vertical members of said gate panel, wherein said first and second vertical legs are prevented from over-rotating during installation of said security gate apparatus between said first and second vertical surfaces.

12. The security gate apparatus of claim 11, wherein said contact pad of said first vertical leg is in a fixed position.

13. The security gate apparatus of claim 12, wherein said contact pad of said second vertical leg is horizontally adjustable.

14. The security gate apparatus of claim 11, wherein said first and second link means are at an angle to a horizontal plane perpendicular to said first and second vertical members of said gate panel upon installation of said security gate apparatus between said first and second vertical surfaces.

15. The security gate apparatus of claim 11, wherein said first and second link means include a pair of pivotable links attached adjacent upper and lower ends of said first and second vertical legs.

16. The security gate apparatus of claim 11, further including a grid between said horizontal and vertical members of said gate panel.

17. The security gate apparatus of claim 11, further including a handle attached to said top horizontal member of said gate panel.

* * * * *